United States Patent [19]

Hakui

[11] Patent Number: 5,046,438

[45] Date of Patent: Sep. 10, 1991

[54] NEEDLE FOR USE IN TUFTING MACHINE

[75] Inventor: Tamotsu Hakui, Osaka, Japan

[73] Assignee: Asahi Trading Co., Ltd., Osaka, Japan

[21] Appl. No.: 447,827

[22] Filed: Dec. 8, 1989

[30] Foreign Application Priority Data

Dec. 20, 1988 [JP] Japan ..... 63-165253[U]

[51] Int. Cl.[5] ..... D05B 85/00

[52] U.S. Cl. ..... 112/222; 112/80.01

[58] Field of Search ..... 112/80.01, 222, 224; 223/102

[56] References Cited

U.S. PATENT DOCUMENTS 3,469,548 9/1969 Zocher ..... 112/222

3,929,082 12/1975 Zocher ..... 112/222

4,480,563 11/1984 Beyer et al. ..... 112/80.01 X

*Primary Examiner*—Werner H. Schroeder

*Assistant Examiner*—Paul C. Lewis

*Attorney, Agent, or Firm*—Wenderoth, Lind & Ponack

[57] ABSTRACT

A needle for a tufting machine has its bottom end pointed and has its lower half portion flattened. The flattened portion has one edge thereof chamferred to form a tapered face. An elongated yarn insert hole is formed above the pointed tip. The hole is inclined at a predetermined angle so that its lowermost point is offset toward the tapered edge relative to a central longitudinal axis of the needle and so that its uppermost point is offset away from the tapered edge relative to the central longitudinal axis.

2 Claims, 3 Drawing Sheets

NEEDLE FOR USE IN TUFTING MACHINE

BACKGROUND OF THE INVENTION

The present invention relates to a needle for use in a tufting machine for manufacturing a tufted carpet.

As shown in FIG. 8, a tufting machine has a vertically movable needle 42 for planting a pile yarn 43 through a web of base cloth 41 being fed horizontally through the machine and a looper 44 for hooking at its tapered tip the planted pile yarn 43 to form loops 45 on the underside of the base cloth 41.

As shown in FIG. 9, a prior art needle for a tufting machine has its bottom end pointed as at 46 and has a thinwalled flat middle portion having one edge thereof chamfered into a tapered face 47 to allow easy insertion of the horizontally movable looper 44 between the yarn and the needle 42. An oval yarn insert hole 48 is formed slightly above the pointed tip 46 so that its major axis will coincide with the axis 49 of the needle 42.

The looper 44 serves to catch the yarn planted through the base cloth 41 to form loops.

In order to produce a patterned carpet by use of pile yarns X, Y and Z of different colors as shown in FIG. 10, it is necessary to swing the needles of a tufting machine laterally (in the direction of arrows A in FIG. 10).

But, if such a prior art needle is swung laterally e.g. by five stitches at one stroke to form a large pattern on a carpet, the pile yarn put through the needle 42 will also be pulled laterally, as shown in FIGS. 11 and 12, and be extremely slanted at a portion between the top end of the yarn insert hole 48 and the side of the looper 44 so that the length a of the yarn at this portion will be too short for the looper to reliably hook the yarn. This will increase the possibility of cutting or mishooking of the yarn, thus making it necessary to repair the pattern afterwards.

It is therefore difficult to form a large and beautiful pattern, on a carpet with such prior art needles.

SUMMARY OF THE INVENTION

It is an object of the present invention to provide a needle for a tufting machine which obviates the above-said shortcomings and which can be moved sideways up to about a five-stitch length at a stroke without the fear of cutting or mishooking of the yarn.

In accordance with the present invention there is provided a needle for a tufting machine having its bottom end pointed and having the lower half portion thereof flattened. The flattened portion has an edge at one side thereof chamfered to form a tapered edge and the needle is formed with a yarn insert hole above the pointed tip. The yarn insert hole is inclined at a predetermined angle so that its lowermost point will be located nearer to the tapered edge than the other edge.

BRIEF DESCRIPTION OF THE DRAWINGS

Other features and objects of the present invention will become apparent from the following description taken with reference to the accompanying drawings, in which.

DETAILED DESCRIPTION OF THE INVENTION

Now referring to FIGS. 1 to 6, the needle for a tufting machine according to the present invention has its intermediate portion cut out at one side as shown at 2 to form a thin-walled flat portion. An edge at one side of the cut surface 2 is chamfered to form a tapered surface 3. The needle has a smoothly finished surface as a whole.

Figure 1:
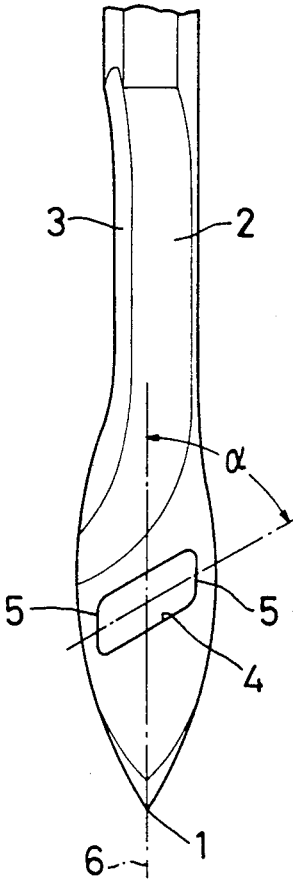
FIGS. 1 to 3 are plan views of portions of the needles embodying the present invention.

A yarn insert hole 4 is formed in the needle between its tip 1 and the bottom end of the cut surface 2 so as to extend obliquely at an angle $\alpha$ of 50 to 60 degrees (FIG. 1). Its lowermost point is located nearer to the tapered edge 3 than the other edge.

Figure 3:
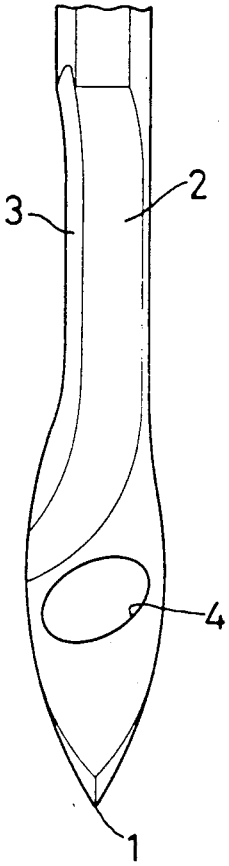
Figure 2:
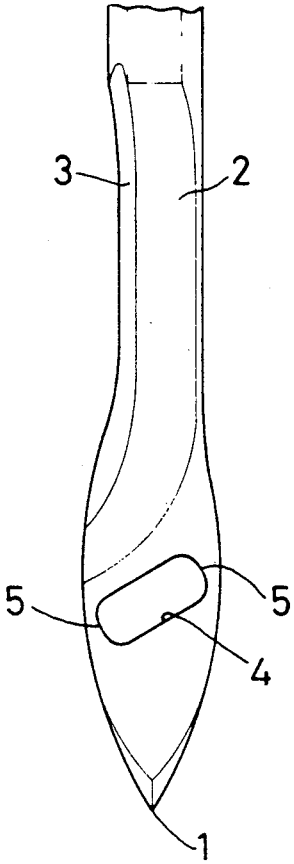
Figure 4:
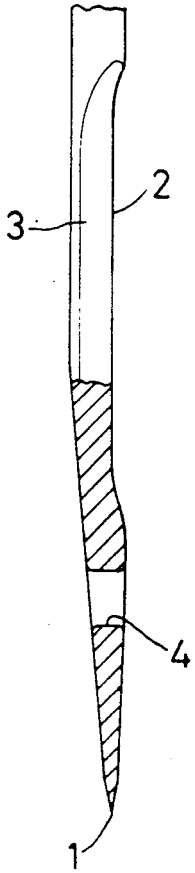
FIG. 4 is a sectional view of the needle of FIG. 2.

The shape of the hole 4 may be parallelogrammatic (as in FIG. 1), rectangular (as in FIG. 2), or oval (as in FIG. 3).

The yarn insert hole 4 of the embodiment of FIG. 1 is in the shape of a parallelogram having its four corners rounded off and its short sides extending in parallel with the axis 6 of the needle. Its peripheral surface is finished up smoothly.

Now the operation of the needle for a tufting machine according to the present invention will be described.

Figure 5:
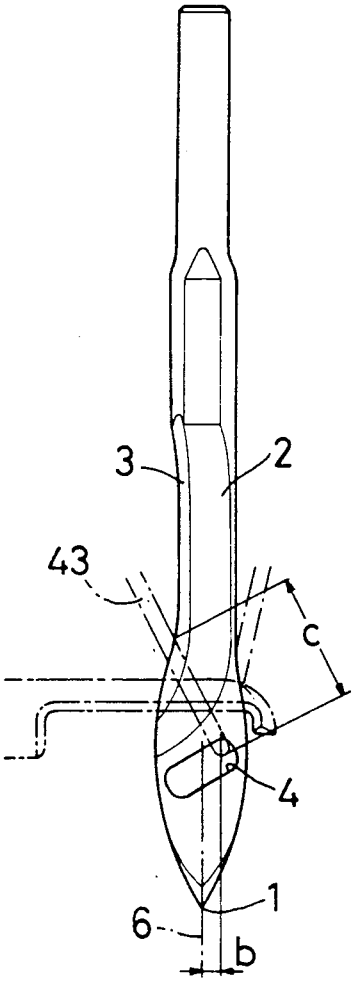
FIG. 5 is a plan view of the needle of FIG. 2 but showing how it is used.
Figure 6:
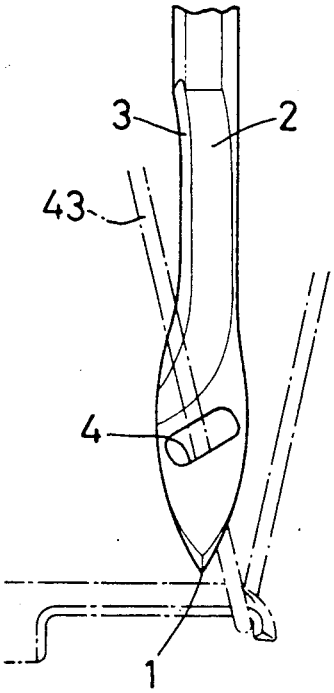
FIG. 6 is a similar view of the needle of FIG. 2 with the needle at a higher position.
Figure 7:
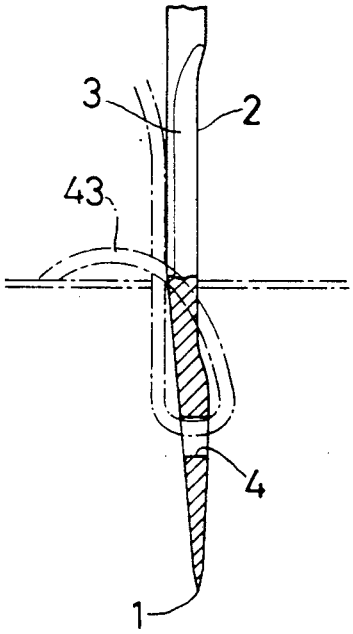
FIG. 7 is a side view of the needle of FIG. 2.
Figure 8:
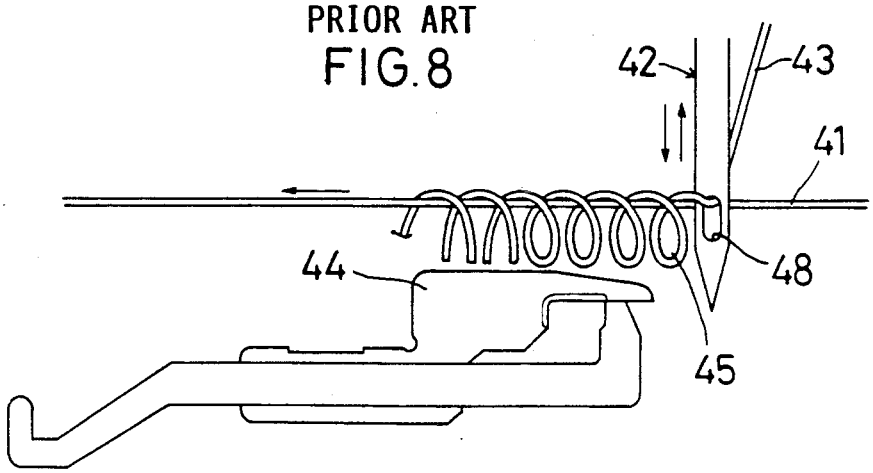
PRIOR ART FIG. 8
FIG. 8 is a view showing how a needle of a tufting machine operates.
Figure 9:
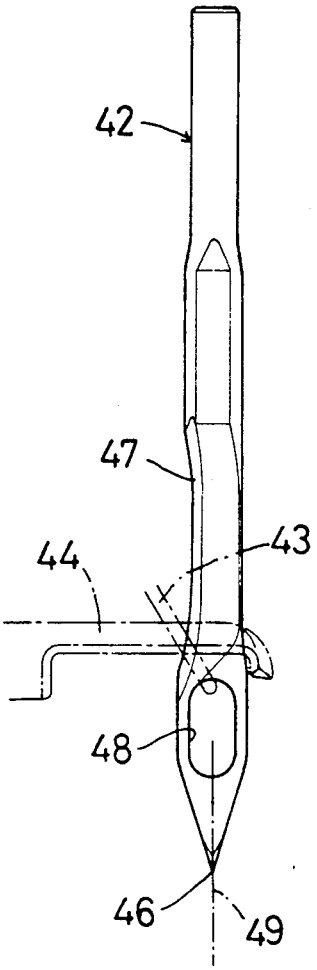
PRIOR ART FIG. 9
FIG. 9 is a plan view of a prior art needle.
Figure 10:
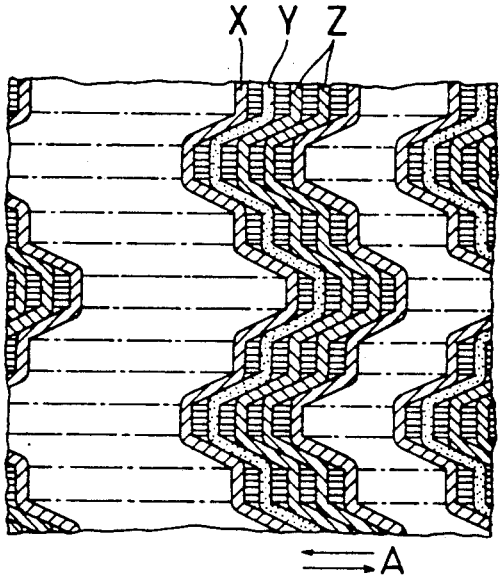
PRIOR ART FIG. 10
FIG. 10 is a bottom plan view of a carpet having a pattern formed with the prior art needle.
Figure 11:
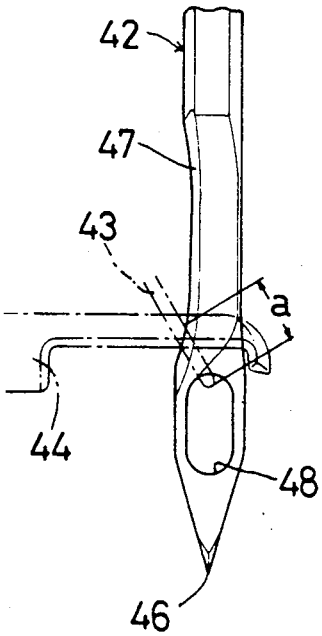
PRIOR ART FIG. 11
FIG. 11 is a plan view of the prior art needle of FIG. 9 showing how it is used.
Figure 12:
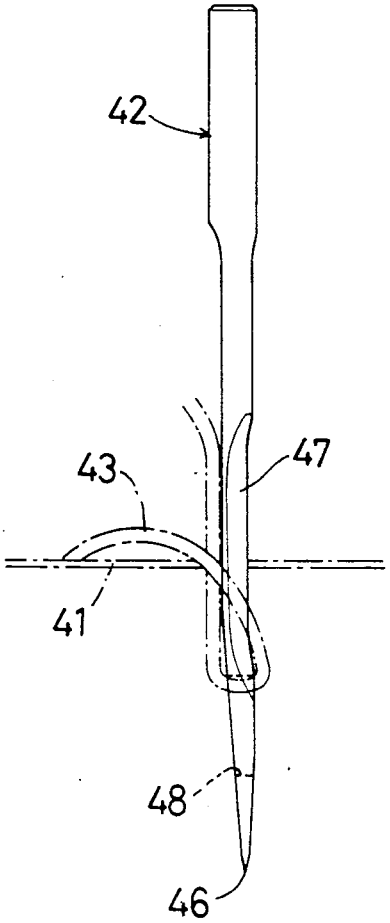
PRIOR ART FIG. 12
FIG. 12 is a side view of the same.

If the yarn 43 pulled by the needle is planted into the base cloth after moving the needle sideways by about five stitches at a stroke, it will engage the needle at the uppermost point in the hole 4, i.e. the point farthest from the axis 6 of the needle. In other words, the yarn 43 will be inclined toward the edge 3, starting from a point apart from the axis 6 of the needle by a distance b and thus, as shown in FIG. 5, the length c of the portion of the yarn 43 in engagement with the side surface of the needle will be longer than that on the prior art needle shown in FIG. 11. This allows the looper to more reliably hook the yarn at its tip.

The needle according to the present invention, which can be moved sideways by a longer distance than any other prior art needle without possibly cutting or mishooking of yarn, will make it possible to form a large and luxurious-looking pattern on a carpet with a greater number of yarns of different colors.

Also, the lower probability of cutting or mishooking increases the productivity and quality, and the fewer repairs required decreases the manufacturing cost.

What is claimed is:

1. A needle for a tufting machine, having:

a bottom end, a top end and a central longitudinal axis;

a pointed tip at said bottom end;

a flattened lower portion having two longitudinal side edges, one of which is chamfered to form a tapered edge; and an elongated yarn insert hole formed transversely through said flattened lower portion above said pointed tip and adapted to carry yarn therein, said elongated yarn insert hole being inclined relative to said central longitudinal axis and having an uppermost and a lowermost point, said lowermost point being offset from said central longitudinal axis toward said tapered edge, and said uppermost point being offset from said central longitudinal axis toward said longitudinal side edge opposite said tapered edge;

such that yarn carried by said needle is adapted to engage a periphery of said elongated yarn insert hole at said uppermost point when the needle is moving downwardly and is adapted to engage the periphery of said elongated yarn insert hole at said lowermost point when the needle is moving upwardly.

2. A needle as recited in claim 1, wherein said central longitudinal axis intersects said pointed tip.

* * * * *